US005758518A

United States Patent [19]

Shu et al.

[11] Patent Number: 5,758,518

[45] Date of Patent: Jun. 2, 1998

[54] METHOD OF FORMING TRANSIT YARN FASTENING PORTION

[75] Inventors: Nobuhisa Shu, Ishikawa-ken; Tetsuo Segura, Niigata-ken, both of Japan

[73] Assignee: Tsudakoma Kogyo Kabushiki Kaisha, Japan

[21] Appl. No.: 759,896

[22] Filed: Dec. 3, 1996

[30] Foreign Application Priority Data

Feb. 13, 1996 [JP] Japan ..... 8-048419

[51] Int. Cl.[6] ..... D04B 1/00; D04B 1/10; D04B 7/24; D04B 7/26

[52] U.S. Cl. ..... 66/64; 66/60 R; 66/128; 66/129

[58] Field of Search ..... 66/60 R, 60 H, 66/61, 62, 64, 75.1, 126, 127, 128, 129

[56] References Cited

U.S. PATENT DOCUMENTS

| | | | |
|---|---|---|---|
| 2,402,200 | 6/1946 | Mack | 66/129 X |
| 4,052,865 | 10/1977 | Zamarco | 66/127 X |
| 4,768,357 | 9/1988 | Ohtake | 66/75.2 |
| 4,909,048 | 3/1990 | Stoll et al. | 66/127 |
| 5,369,966 | 12/1994 | Morita et al. | 66/127 X |
| 5,476,616 | 12/1995 | Schwarz . | |
| 5,487,282 | 1/1996 | Kuhnert | 66/174 X |
| 5,537,843 | 7/1996 | Okuno | 66/64 |

FOREIGN PATENT DOCUMENTS

| | | | |
|---|---|---|---|
| 0641879 | 3/1995 | European Pat. Off. . | |
| 0699791 | 3/1996 | European Pat. Off. . | |
| 0754792 | 1/1997 | European Pat. Off. . | |
| 6316841 | 11/1994 | Japan | D04B 7/28 |
| 80158210 | 6/1996 | Japan . | |

*Primary Examiner*—John J. Calvert

*Attorney, Agent, or Firm*—Webb Ziesenheim Bruening Logsdon Orkin & Hanson, P.C.

[57] ABSTRACT

The invention provides a method by which a transit yarn fastening portion can be formed with a comparatively small number of steps by a flat knitting machine. The method of forming a transit yarn fastening portion is performed in a method of forming, by a flat knitting machine including a yarn carrier and two needle beds, a knit fabric having a transit yarn section in which a yarn from the yarn carrier is not knitted and forms a transit yarn portion and a knitting section in which the yarn from the yarn carrier is knitted, and includes the steps of successively forming two or more loops of the transit yarn by one of needles of that one of the needle beds which does not contribute to knitting which needle is located in the proximity of a boundary between the transit yarn section and the knitting section, and transferring the loops formed in the first step to one of needles on the other needle bed which contributes to knitting.

3 Claims, 14 Drawing Sheets

Wc
Wb
$18_1$
$18_2$
$18_3$
$18_4$ 22b
20b
22a
52
$16_1$
$16_2$
$16_3$
$16_4$
$16_5$ 22b
20b
22a
52
50
$18_3$ 22b
20b
22a
$16_1$
$16_5$
52
$18_3$ 22b
20b
22a
$16_1$
$16_5$

FIG.4(A)
FIG.4(B)
FIG.4(C)
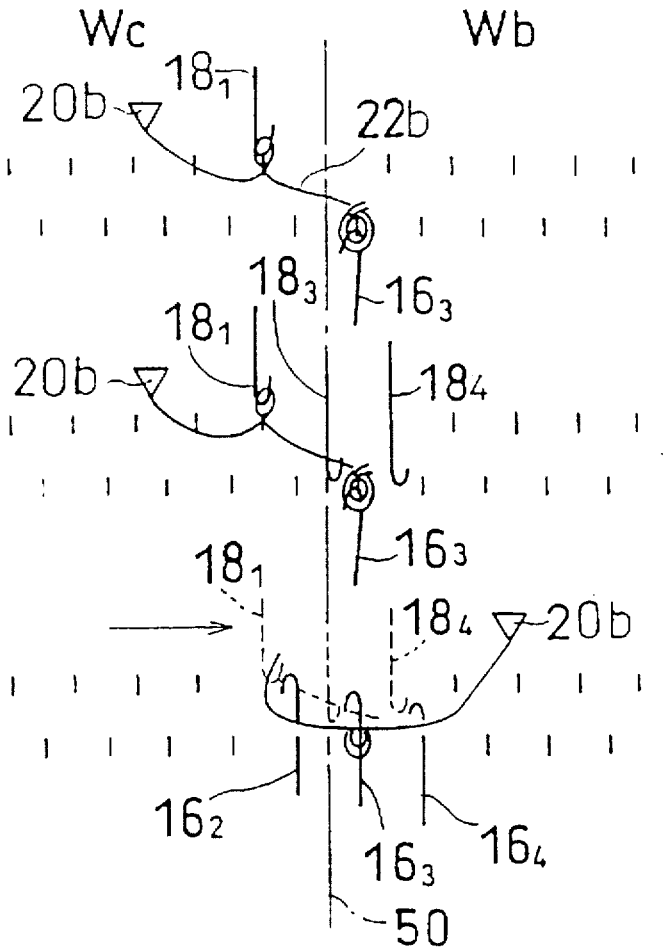
FIG.5(A)
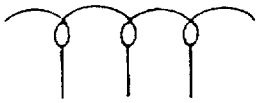
FIG.5(B)
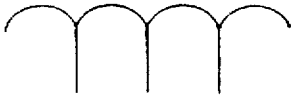

Wc
Wb
20b
22a
22b
20a
16₀
16₃

18₀
20a
22a
58
50

18₀
20b
18₁
22b
20a
22a
16₃

18₀
18₁
18₃
22b
20b
22a
20a
16₁
16₃
16₅

Wc
Wb
58
50

$18_3$
$18_1$
$18_0$
20b
22a
20a
$16_1$
$16_3$
$16_5$
20b
$18_3$ $18_0$
$18_1$
22a
20a
$16_1$
$16_3$
$16_5$
20b
$18_3$ $18_0$
$18_1$
22a
22a
20a
$16_1$
$16_3$
$16_5$
$18_3$ $16_3$

METHOD OF FORMING TRANSIT YARN FASTENING PORTION

BACKGROUND OF THE INVENTION

1. Field of the Invention

This invention relates to a method of forming a transit yarn fastening portion upon knitting of a knit fabric such as an intarsia fabric on which transit yarn portions appear.

2. Description of the Prior Art

In a multi-color single knit fabric such as an intarsia knit fabric, two kinds of sections are present in the same course. One section is a knitting section in which a particular yarn is knitted, arid the other section is a non-knitting section in which not the particular yarn but another yarn is knitted. If the non-knitting section is present between a start point of the particular yarn and the knitting section, then the particular yarn supplied forms a transit yarn portion, i.e., crossover yarn portion, in the non-knitting section.

In knitting of such a multi-color single knit fabric on which transit yarn portions appear as described above, in order to prevent a transit yarn portion from coming loose at a start point portion and an end point portion of a knitting section, an operation for forming a transit yarn fastening portion by which the transit yarn is fastened to another yarn in the proximity of a boundary between the knitting section and each adjacent transit yarn section, i.e. non-knitting section, is performed. Such a transit yarn fastening portion is formed by fastening or coupling the transit yarn to another yarn by knotting, binding or the like.

One of methods of forming a transit yarn fastening portion is disclosed in Japanese Patent Appln. Public Disclosure No. 6-316841 wherein the method is performed on a flat-knitting machine including two needle beds. In the conventional method, however, a large number of steps must be performed in order to form a transit yarn fastening portion including the steps of transferring a loop of a yarn (old yarn) knitted latest, forming three first loops on a transit yarn (new yarn) , forming two second loops on the transit yarn by another needle, transferring one of the first loops, looping off another one of the first loops, forming a single third loop on the transit yarn, transferring one of the second loops, forming all single fourth loop on the transit yarn, looping off the remaining third loop, transferring back the loop of the old yarn and looping off the remaining one of- the second loops.

SUMMARY OF THE INVENTION

It is an object of the present invention to provide a method by which a transit yarn fastening portion can be formed finely and readily with a comparatively small number of steps by a flat-knitting machine.

In order to attain the object described above, according to the present invention, there is provided a method of forming a transit yarn fastening portion in a method of forming, by a flat-knitting machine including a yarn carrier and two needle beds, a knit fabric having a transit yarn section in which a yarn from the yarn carrier is not knitted and forms a transit yarn portion and a knitting section in which the yarn from the yarn carrier is knitted, the method comprising the steps of successively forming two or more loops of the transit yarn by one of needles of the needle bed which does not contribute to knitting, which needle is located in the proximity of a boundary between the transit yarn section and the knitting section, and transferring the loops formed in the first step to one of needles on the other needle bed which contributes to knitting.

With the method, a transit yarn fastening portion is formed by successively forming two or more loops on a transit yarn, for example, by a same needle in the proximity of a boundary between the transit yarn section and the knitting section and transferring the loops to another needle on the other needle bed. Consequently, the transit yarn fastening portion can be formed more finely and readily with a reduced number of steps by a flat-knitting machine.

When the transit yarn moves, the step of successively forming two or more loops may include the steps of catching the transit yarn by one of needles of the needle bed contributing to knitting which is located in the proximity of the boundary by tucking, forming a first loop of the transit yarn by the needle located in the proximity of the boundary from among the needles of the needle bed which does not contribute to knitting, catching the transit yarn by another one of the needles of the needle bed contributing to knitting which is located in the proximity of the boundary by tucking, and forming a second loop or a second and following loops of the transit yarn by the needle located in the proximity of the boundary from among the needles of the needle bed which does not contribute to knitting.

The flat-knilting machine on which the method of the present invention is performed is preferably, for example, a carriageless flat-knitting machine which does not include a carriage for cams for reciprocating a plurality of needles. In the carriageless flat-knitting machine, the needles are individually reciprocated by actuators such as linear motors provided respectively therefor. In ordinary knitting, the needles are individually reciprocated in synchronism with a movement of a yarn carrier. One of the carriageless flat-knitting machines of the type just described is disclosed in U.S. Pat. No. 4,768,357. However, the method of the present invention can be performed by using a flat knitting machine of the cam type which includes a carriage for cams for reciprocating a plurality of needles.

The above and other objects, features and advantages of the present invention will become apparent from the following description and the appended claims, taken in conjunction with the accompanying drawings in which like parts or elements are denoted by like reference characters.

BRIEF DESCRIPTION OF THE DRAWINGS

FIGS. 2(A) to 2(D), 3(A) to 3(D) and 4(A) to 4(C) are schematic views showing different steps of an embodiment of a method of forming a transit yarn fastening portion at a knitting start point of a transit yarn according Lo the present invention;

FIGS. 5(A) and 5(B) are schematic illustrations of different representations in FIGS. 2 to 4 and 14 to 16;

DESCRIPTION OF THE PREFERRED EMBODIMENFS

Figure 1:
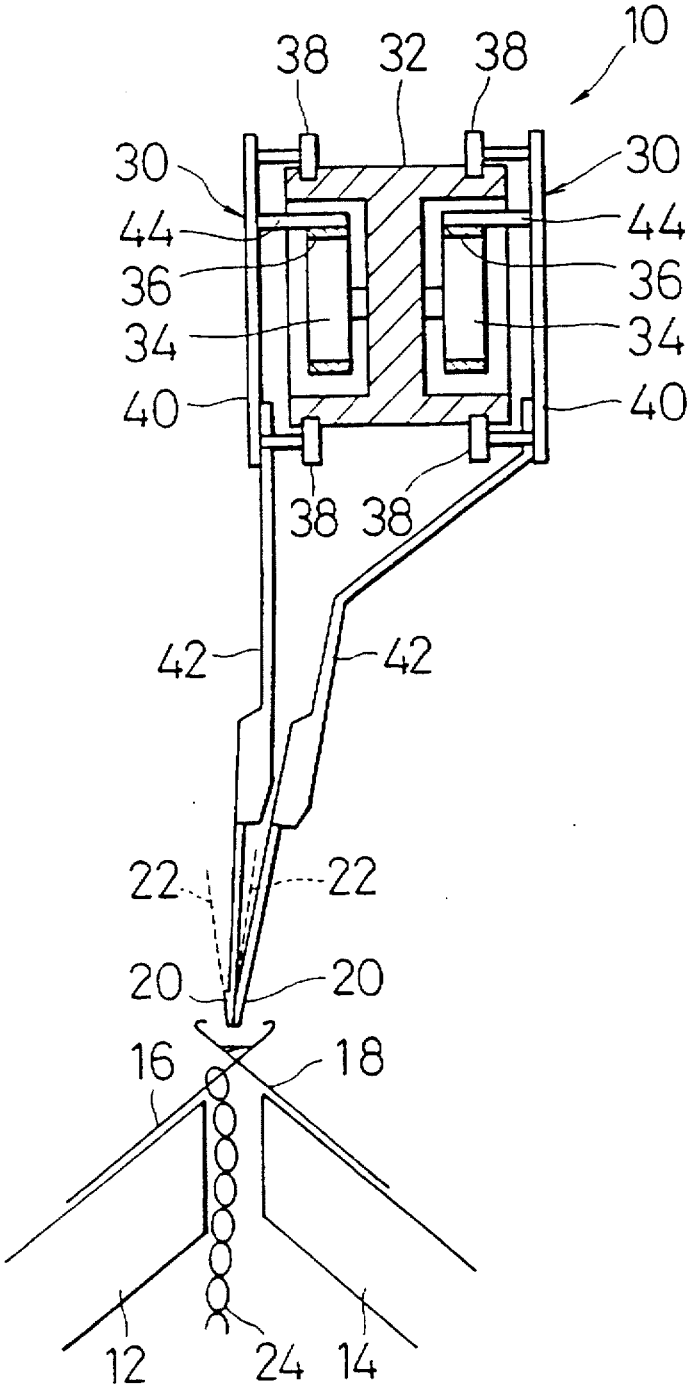
FIG. 1 is a schematic side elevational view showing needles, yarn carriers and yarn supply units of a flat-knitting machine on which a method of forming a transit yarn fastening portion according to the present invention is performed.

Referring first to FIG. 1, there is shown an embodiment of a carriageless flat-knitting machine 10 for performing a method of forming a transit, yarn fastening portion according to the present invention. The carriageless flat-knitting machine 10 includes, in order to knit a multi-color single knit fabric, two needle beds 12 and 14 disposed in an inverted V-shaped configuration, a plurality of needles 16 and 18 arranged in parallel to each other on the needle beds 12 and 14, respectively, and a plurality of yarn feeders or yarn carriers 20 each having one or more yarn guide holes.

The needles 16 on the front side and the needles 18 on the rear side are arranged so as to have a structure of rib setting of needles to knit an all rib stitch and intersect with each other at front end portions thereof when they are advanced. Each of the needles 16 and 18 is reciprocated in a predetermined pattern based on a predetermined knitting plan in synchronism with a movement of a yarn carrier 20 by an actuator or preferably a linear motor.

Figure 9:
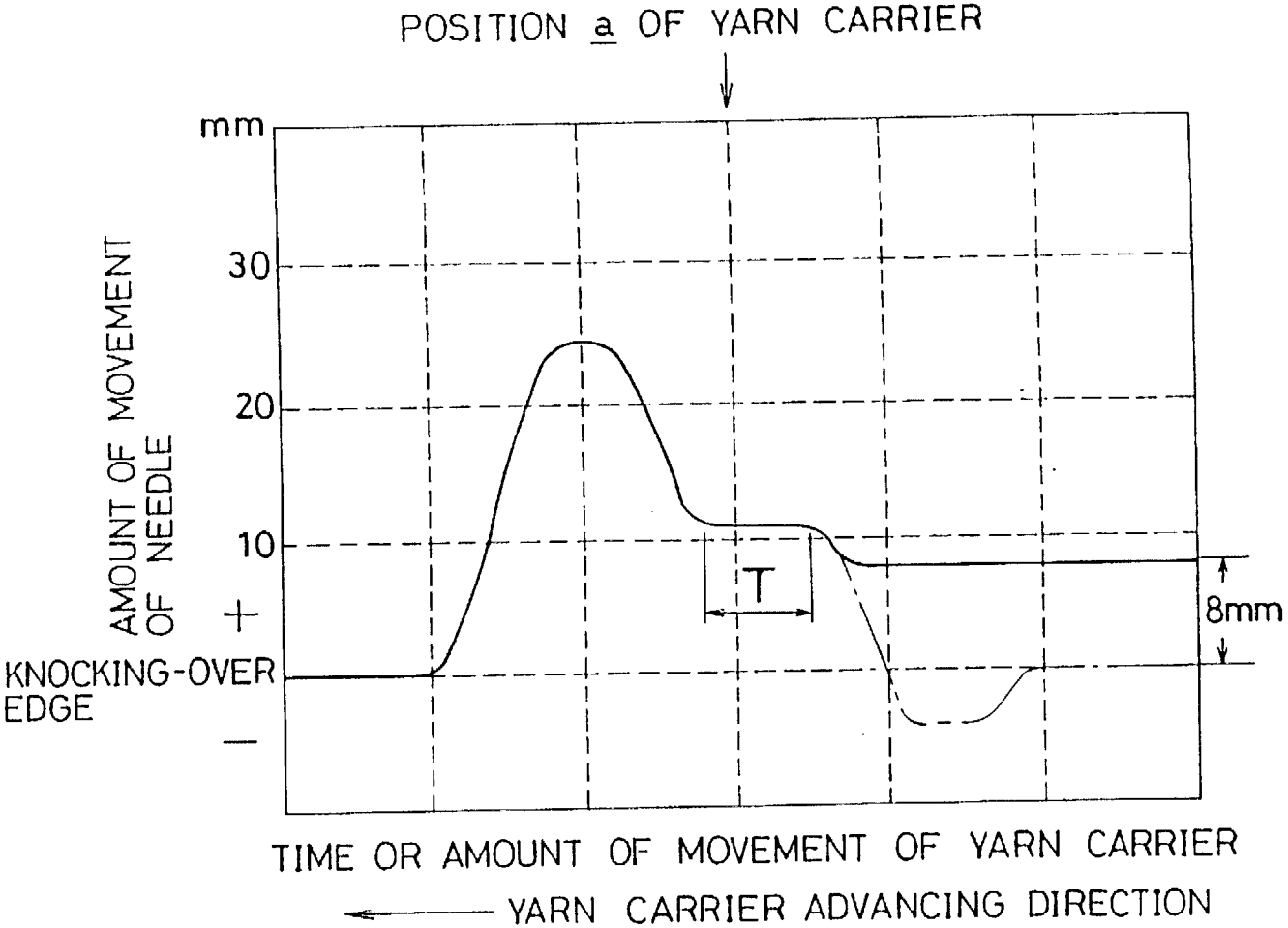
FIG. 9 is a diagram showing a form of an operation pattern.
Figure 10:
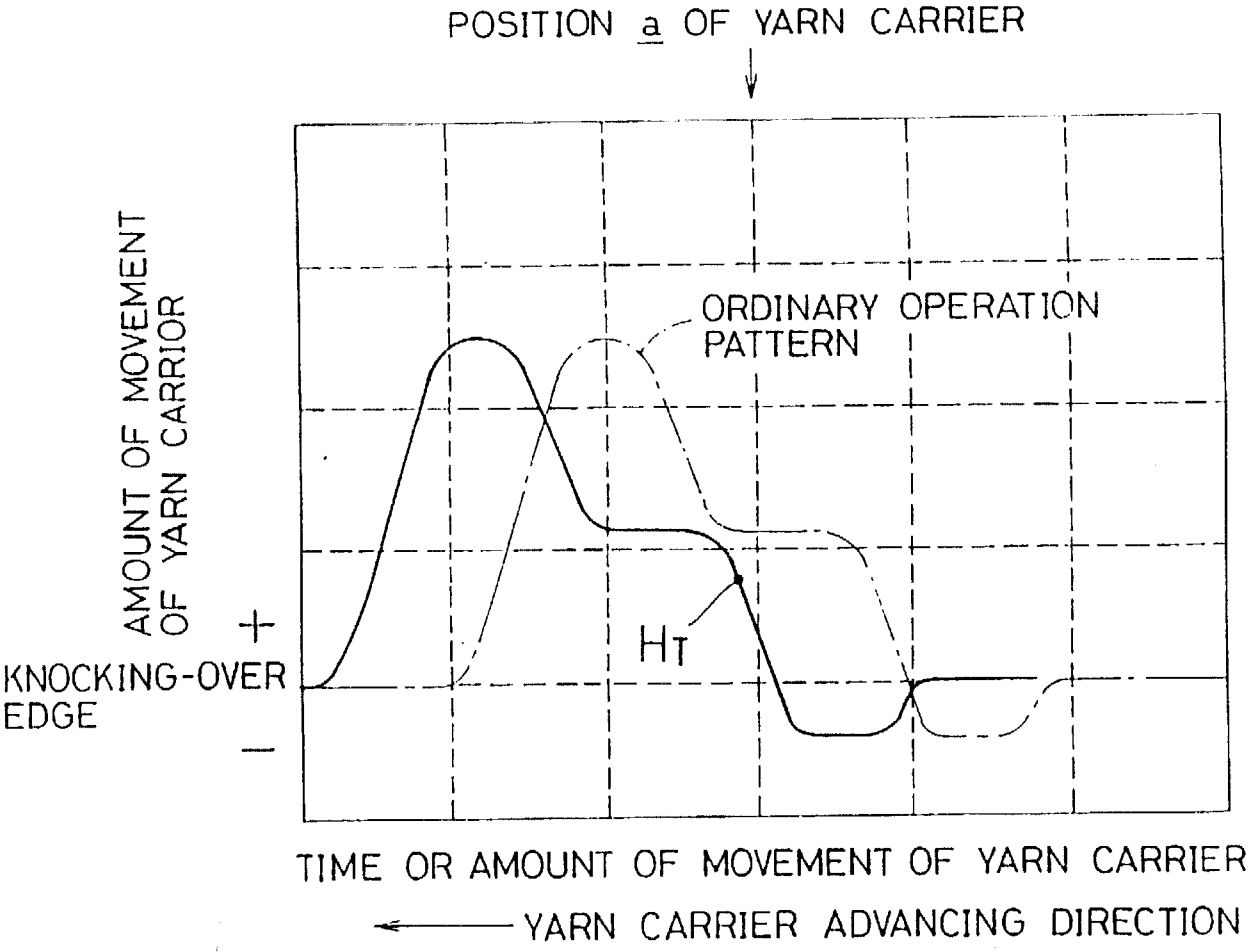
FIG. 10 is a similar view showing another form of an operation pattern.

The pattern of the reciprocation of each needle can be represented in a chart wherein the axis of ordinate represents the amount of movement of the needle with respect to the position of zero given by the position of the knocking-over edge and the axis of abscissa represents the amount of movement of the yarn carrier or the time. Such a pattern is called wave pattern, knit pattern, operation pattern, needle movement pattern and so forth. In the description below, such a pattern is referred to as "operation pattern". Different forms of the operation pattern are shown in FIGS. 9 and 10.

Knitting yarns 22 of different types are threaded through the individual yarn carriers 20. Each of the yarn carriers 20 is reciprocated transversely above intersecting locations of the needles 16 and 18 by a yarn supply unit 30 so that it supplies the knitting yarn 22 from above to the intersecting locations of the needles 16 and 18. The movement of each of the yarn carriers 20 is set based on the predetermined knitting plan.

The yarn supply units 30 are supported so as to reciprocate in a longitudinal direction of and on a common rail 32 assembled to a frame of the knitting machine such that it extends transversely with respect to the frame. A driving mechanism for individually moving each of the yarn supply units 30 includes a pair of pulleys 34 mounted so as to rotate at locations of the rail 32 spaced away from each other in the longitudinal direction of the rail 32, and an endless belt 36 extending between the two pulleys.

Each of the yarn supply units 30 includes a traveling member 40 supported so as to reciprocate in the longitudinal direction of and on the rail 32 by a plurality of rollers 38, a stay 42 extending from the traveling member 40, and a connection member 44 for connecting the traveling member 40 to the endless belt 36. The rail 32 has a pair of guide grooves for partially receiving the rollers 38. Each of the yarn carriers 20 is attached to an end portion of the stay 42 of the corresponding yarn supply unit 30. Each of the yarn supply units 30 is reciprocated based on the predetermined knitting plan as the corresponding endless belt 36 is circulated in a reciprocating fashion by forward and backward rotations of a corresponding source of rotation not shown.

While, in the example shown in FIG. 1, only one pair of yarn supply units 30 are shown, where the knitting machine includes three or more yarn carriers, either a plurality of pairs of yarn supply units 30 are disposed on the rail 32 or a plurality of yarn supply unit assemblies are disposed in the leftward and rightward directions in FIG. 1. Each of yarn supply unit assemblies includes a plurality of yarn supply units 30 arranged on the rail 32 as shown in FIG. 1.

In the following description, needles which principally directly contribute to knitting, that is, perform knitting, are described as the needles 16 on the front side while needles which indirectly contribute to knitting, that is, do not perform knitting, are described as the needles 18 on the rear side. While loops at a foremost end of a knit fabric 24 are, in the example shown in FIG. 1, confined by the needles 16 on the front side, they may otherwise be confined by the needles 18 on the rear side. A control unit for controlling actuators for driving the needles and driving sources for the yarn supply units will be hereinafter described in detail with reference to FIG. 17.

Method of Forming a Yarn Fastening Portion at a Knitting Start Point of a Transit Yarn An embodiment of the present invention is described below with reference to FIGS. 2(A) to 4(C). In the embodiment, an intarsia fabric 24 of the knit pattern shown in IIG. 6 is knitted by a carriageless flat-knitting machine.

Figure 6:
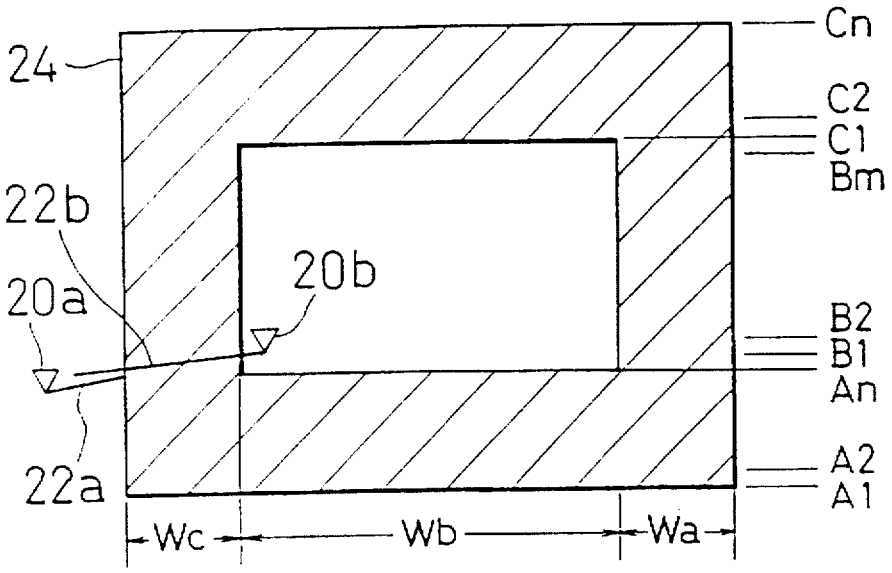
FIG. 6 is a diagrammatic view showing a knitting pattern of an intarsia knit fabric and illustraLing a method of knitting the intarsia knit fabric.

In the knit fabric 24 of FIG. 6, courses A1 to An and C1 to Cn are knitted with a black yarn 22*a* from a yarn carrier 20*a* in all sections Wa, Wb and Wc. The knit fabric 24 is knitted in the order of the courses A1 to An, courses B1 to Bm and courses C1 to Cn.

The courses B1 to Bm are knitted with the black yarn 22*a* from the yarn carrier 20*a* in the section Wa, with a white yarn 22*b* from another yarn carrier 20*b* in the section Wb, and with a black yarn not shown from a further yarn feeder not shown in the section Wc. In this instance, in each of the courses B1 to Bm, the yarn 22*b* forms a transit yarn portion in each of the sections Wa and Wc, and the start point of the transit yarn portion is the left, end of the knit fabric when the yarn carrier 20*b* moves from the left to the right, but when the yarn carrier 20*b* moves from the right to the left, the start point is the right end of the knit fabric.

FIGS. 2(A) to 2(D), 3(A) to 3(D) and 4(A) to 4(C) illustrate an embodiment wherein, when the yarn carrier 20*b* is moved from the left to the right to knit the course Bi with the yarn 22*b*, a fastening portion for the yarn 22*b* is formed in the proximity of a boundary between the sections Wb and Wc. Therefore, in the present embodiment, the sections Wa and Wc of the knit fabric 24 of FIG. 6 are transit yarn sections of the yarn 22*b* while the section Wb is a knitting section of the yarn 22*b*.

In FIGS. 2, 3 and 4, each portion of a graphic form shown in FIG. 5(A) represents a step in which knitting of a yarn is performed while each portion of another graphic form shown in FIG. 5(B) represents another step in which tucking of a yarn is performed. Further, needles shown on the lower stage are needles on the front side needle bed, that is, needles which contribute to knitting, and needles shown on the upper stage are needles on the rear side needle bed, that is, needles which do not contribute to knitting. In the following description, needles on the front side needle bed are referred to as "front needles", and needles on the rear side needle bed are referred to as "rear needles". Further, a line 50 at the center indicates the boundary between the sections Wb and Wc shown in FIG. 6, and the section on the right side with respect to the line 50 is the section Wb while the other section on the left side with respect to the line 50 is the section Wc.

Referring to FIG. 6, in the courses A1 to An, the yarn carrier 20*a* is reciprocated in the leftward and rightward directions to knit all of the sections Wa, Wb and Wc with the yarn 22*a*. Therefore, at a point of time when knitting of the course An is ended, loops 52 of the yarn 22*a* are formed by the front needles as shown in FIGS. 2 to 4.

The front and rear needle beds are arranged so as to knit an all needle structure rib stitch. The yarn carriers 20*a* and 20*b* stand by at the left end in FIG. 6, and the remaining yarn carrier not shown stands by at the boundary between the sections Wa and Wb.

Figures 2A, 2B, 2C, 2D:
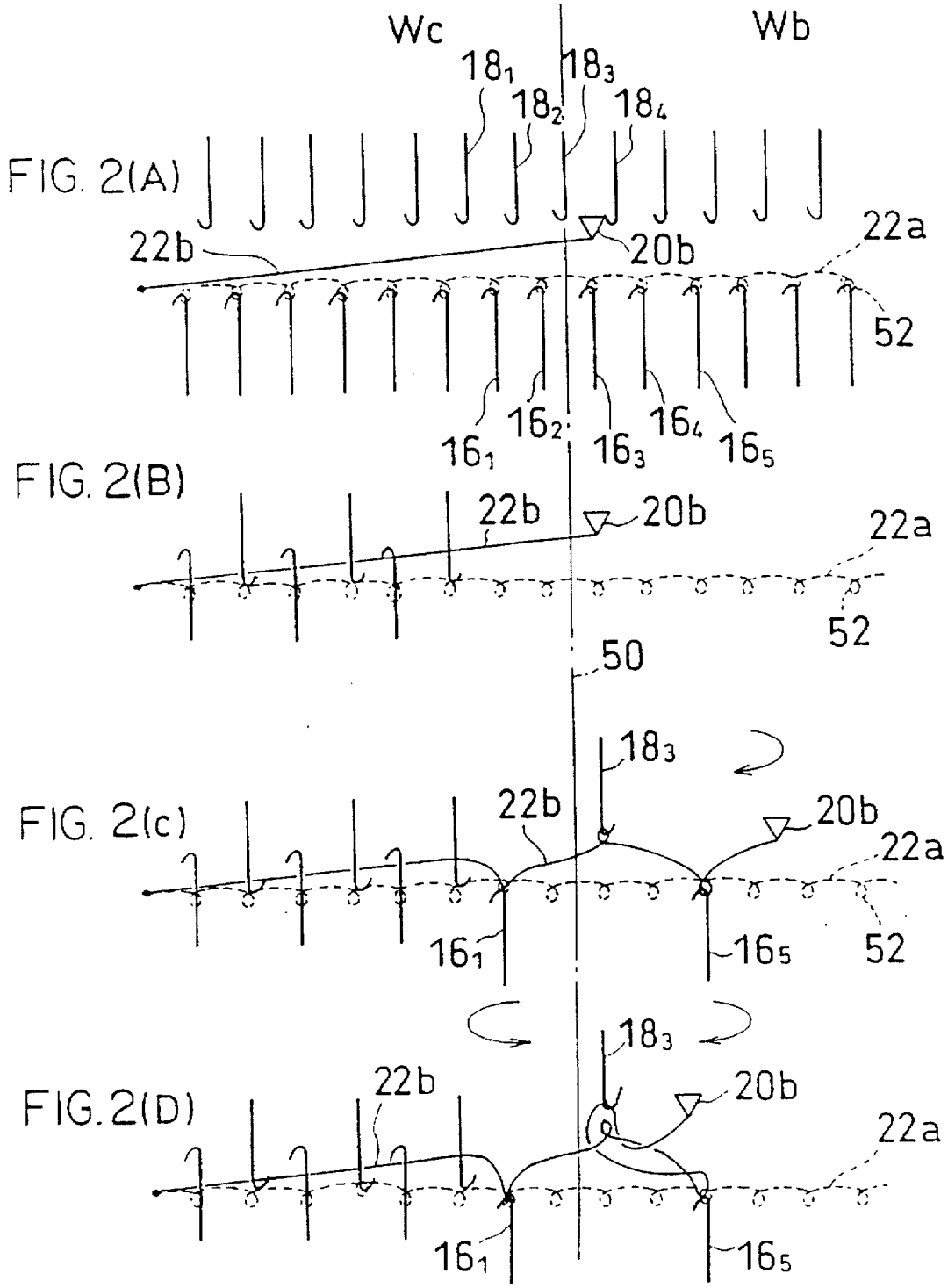

In the condition described above, the yarn carrier 20*b* is first moved rightwardly from the start point on the left to the left end of the section Wb as shown in FIG. 2(A). Thereupon, as the yarn carrier 20*b* moves, a plurality of needles corresponding to the section We are successively advanced to project from the needle beds to hold down the yarn 22*b* low as shown in FIG. 2(B). Consequently, the yarn 22*b* is caught by a needle 16 or 18 advanced at the terminal end of the transit yarn section Wc with certainty.

Figure 7:
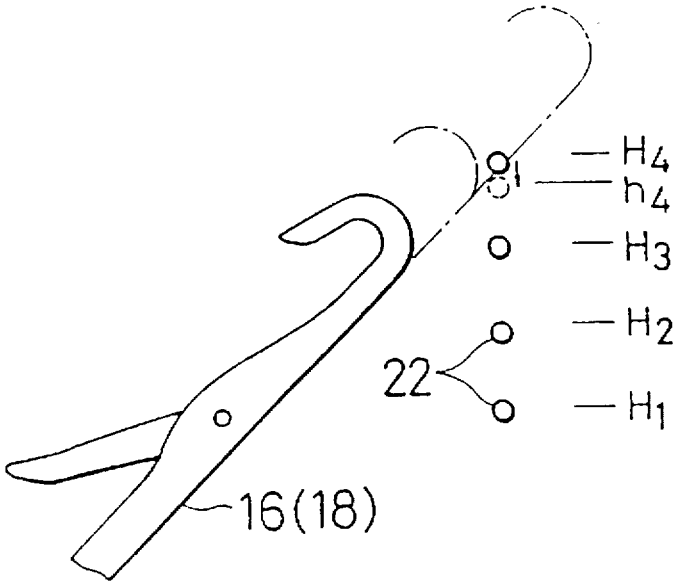
FIG. 7 is a schematic view illustrating different heights of a transit yarn with respect to a needle.

This is because, although the transit yarn is held down, at the start point, low to the height level of the fabric, since the yarn carrier moves above the needles, if a yarn 22 is not otherwise held down low, the path of the yarn 22 with respect to the needles 16 or 18 in the transit yarn section Wb, that is, the height of the yarn 22, gradually increases like H1, H2, H3 and H4 as shown in FIG. 7 from the start point side of the yarn 22 toward the yarn carrier until, at the terminal end of the transit yarn section, the yarn 22 comes to a height at which it is not likely to be caught by an advanced needle 16 or 18.

If the plurality of needles corresponding to the transit yarn section are successively advanced beginning with the needle nearest to the start point of the transit yarn portion after the yarn carrier passes, then the yarn 22 is first brought into contact, upon advancement of one of the needles, with the front end of the needle and then guided, as the needle is further advanced, along an arcuate portion of the end of the needle to a lower face of the needle. Consequently, the height of the yarn 22 extending from the start point to the yarn carrier is held down to h4 at the location of the needle, and then, the yarn 22 is held down to a substantially equal height by another needle advanced next to the needle. As a result, the transit yarn is caught with certainty by a needle at the terminal end of the transit yarn section.

Figure 8A:
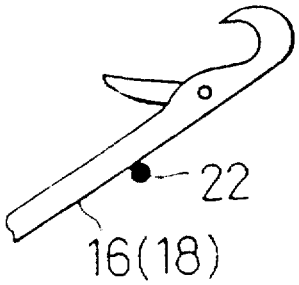
FIGS. 8(A) and 8(B) are schematic views showing different conditions in which a transit yarn is held down by a needle and opposing needles, respectively.
Figure 8B:
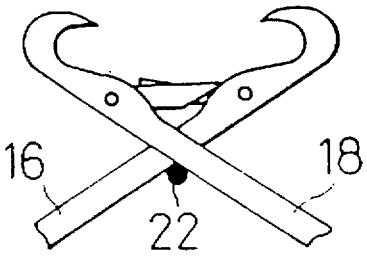

The needles on one of the front and rear needle beds may be successively advanced as shown in FIG. 8(A) or the needles on both of the front and rear needle beds may be successively advanced as shown in FIG. 8(B). Where the front needles 16 are advanced, preferably they are not advanced farther than the tuck position so that the latches thereof may not be cleared by loops carried on the needles. Where the rear needles 18 are advanced, since they are empty needles having no loops thereon, they may be advanced to the clearing position. Where the needles on both of the needle beds are advanced, the amounts of advancement of the needles are set in such a manner as described above depending upon whether or not the needles belong to a needle bed which contributes to knitting.

FIG. 9 indicates by a solid line an operation pattern of a needle when the transit yarn is held down. The operation pattern shown in FIG. 9 is a so-called special tucking operation pattern wherein a yarn is tucked by a needle. At the final position in the operation pattern, the needle projects by approximately 8 mm in FIG. 9.

In FIG. 9, another operation pattern for an ordinary loop is indicated by part of the solid line and a succeeding alternate long and short dash line. Another operation pattern represents that a needle standing by at the position of the knocking-over edge is first advanced farther than the position of the knocking-over edge and then retracted by a predetermined distance toward the knocking-over edge in order to catch a knitting yarn, and then it remains at the position for a predetermined period T and then is retracted to and farther than the position of the knocking-over edge, whereafter it is returned to and then stands by at the position of the knocking-over edge with the yarn caught thereon. However, the operation pattern is different depending upon a fabric to be knitted. Where the axis of abscissa indicates the amount of movement of the yarn carrier, FIG. 9 represents the positions of the tip end of the needle when the yarn carrier which travels from the right to the left in FIG. 9 comes to the position indicated by a reference mark a in the form of a continuous curve.

The needles successively advanced in order to push down or hold down the transit yarn may be retracted at an arbitrary timing after the transit yarn is caught by a needle nearer to the yarn carrier than the successively advanced needles such as the last needle in the transit yarn section or the first needle in a knitting section next to the transit yarn section, or may be successively retracted in the same order in advancement after the next needles are advanced. In the latter case, preferably at least the needle advanced last from among the successively advanced needles, or more preferably a plurality of needles advanced last, are not retracted until after the transit yarn is caught by a predetermined needle.

It is to be noted that, where the yarn carrier is moved down to a height position at which the transit yarn is caught with certainty by a needle or needles in the proximity of the terminal end of the transit yarn section, a plurality of needles corresponding to the transit yarn section need not be advanced to hold down the transit yarn by the needles. In place of holding down the transit yarn by the needles, compressed air may be blown to the transit yarn to hold down the transit yarn.

Figures 11A, 11B, 11C, 11D:
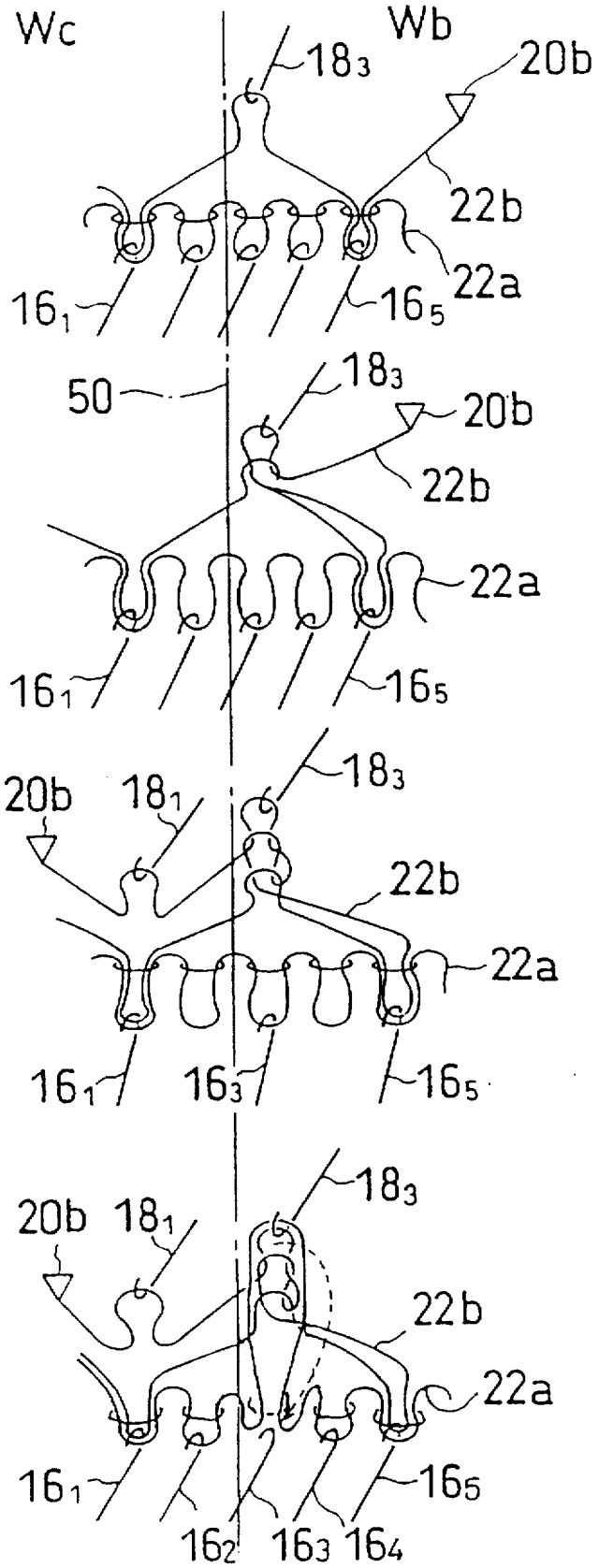
FIGS. 11(A) to 11(D) are schematic views showing different knitting conditions in the course of the process illustrated in FIGS. 2 to 4.

Then, the yarn carrier 20*b* is moved rightwardly farther than a front needle $16_1$ in the section Wc as shown in FIG. 2(C) while the single front needle $16_1$ in the proximity of the terminal end (right end) of the section Wc tucks the yarn 22*b*. Then, a first (left end) rear needle $18_3$ in the section Wb knits the yarn 22*b*, whereafter one front needle $16_5$ in the proximity of the start end (left end) of the section Wb tucks the yarn 22*b*. Consequently, a tuck loop by the front needle $16_1$, a knit loop by the rear needle $18_3$ and another tuck loop by the front needle $16_5$ are successively formed and carried as shown in FIGS. 2(C) and 11(A).

The tucking is performed by forming a loop with a loop size smaller than that of an ordinary loop based on the special tucking operation pattern shown in FIG. 9. The knitting is performed by forming a loop with a loop size of an ordinary loop by ordinary knitting represented by part of the solid line and the succeeding alternate long and short dash line in FIG. 9. While, in the example illustrated in FIG. 2(C), the tucking and the knitting are performed by every second needles, they may alternatively be performed by adjacent needles or by needles spaced by a plurality of needle distances from each other such as every third needles or every fourth needles. Meanwhile, the needle $18_3$ for knitting the yarn 22*b* is not limited to the first rear needle in the section Wb only if it is located in the proximity of the boundary between the sections Wb and Wc. For example, the needle may be another rear needle in the section Wb or a rear needle in the section Wc. In this instance, for a pair of front needles to perform tucking, two front needles spaced away from each other with the rear needle positioned therebetween are used.

Then, the yarn carrier 20*b* is returned leftwardly farther than the rear needle $18_3$ at the left end of the section Wb and then moved rightwardly farther than the rear needle $18_3$ at the left end of the section Wb as shown in FIG. 2(D). When the yarn carrier 20*b* is moved rightwardly, the rear needle $18_3$ knits the yarn 22*b* rather loosely. As apparently seen from FIGS. 2(D) and 11(B) which show loops then more accurately, a further knit loop is formed by and carried on the rear needle $18_3$.

Figure 3A:
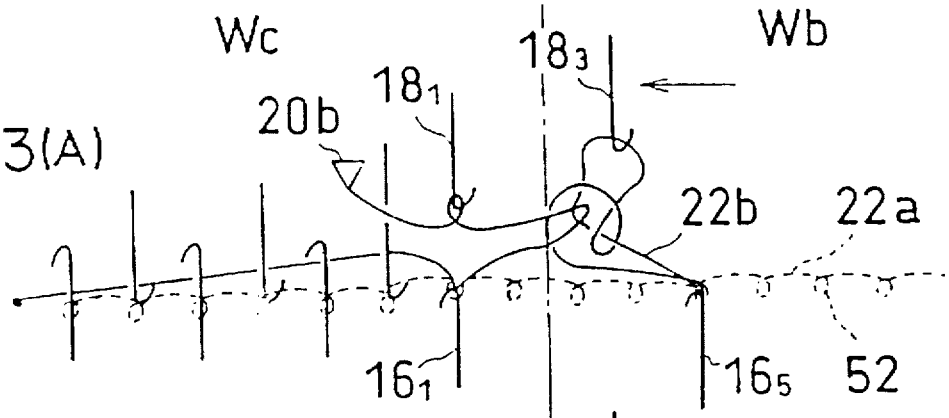

Then, the yarn carrier 20*b* is returned leftwardly farther than a rear needle $18_1$ of the section Wc while the rear needle $18_3$ knits the yarn 22*b* loosely again and the rear needle $18_1$ in the section Wc knits the yarn 22*b* loosely as shown in FIG. 3(A). As apparently seen from FIG. 11(C) which accurately shows loops then, knit loops are successively formed by and carried on the rear needles $18_3$ and $18_1$.

Figure 3B:
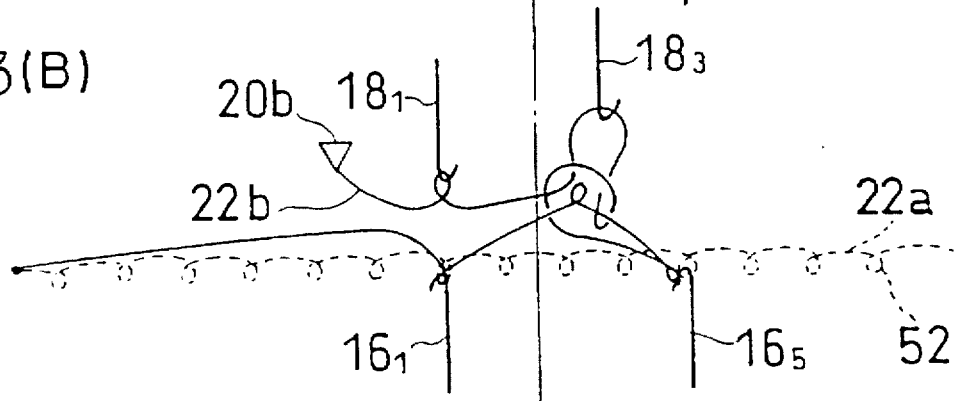

Then, the needles which have held down the transit yarn are retracted back to the original position as shown in FIG. 3(B).

Figure 3C:
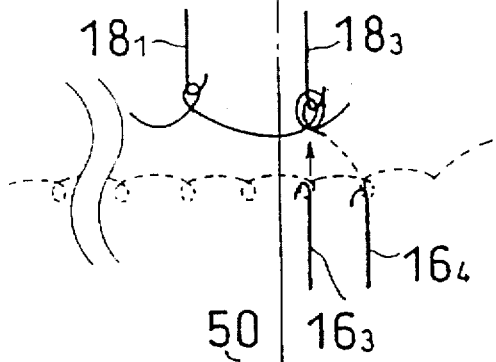

Then, the front and rear needle beds are relatively displaced to the positions in which transfer of loops can be performed. Thereafter, a knit loop carried on a front needle $16_3$ opposing to the rear needle $18_3$ as shown in FIG. 3(C) is transferred to the rear needle $18_3$ by a loop transferring operation. Consequently, the two knit loops of the different yarns, that is, the knit loop of the yarn 22*a* and the knit loop of the yarn 22*b* are carried in an overlapping relationship on the rear needle $18_3$.

Figure 3D:
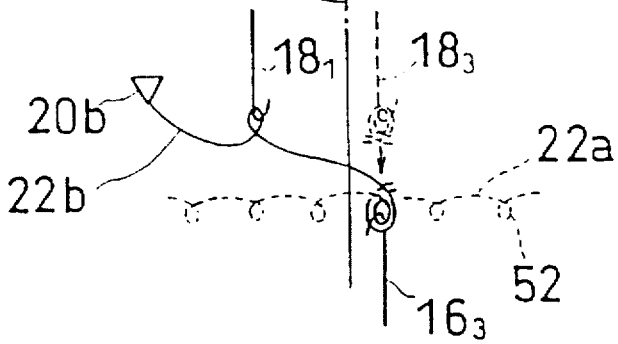

Then, the two knit loops carried on the rear needle $18_3$ as shown in FIG. 3(D) are transferred to the front needle $16_3$ by a loop transferring operation. Consequently, the two knit loops of the different yarns, that is, the knit loop of the yarn 22*a* and the knit loop of the yarn 22*b* are carried in an overlapping relationship on the front needle $16_3$.

The relationship between the traveling direction (rightward or leftward direction) of the yarn carrier 20*b* and the knitting or tucking operation by the needles $16_1$, $16_2$ and $18_3$ in the step illustrated in FIG. 2(C) or 2(D) is not limited to the specific one of the embodiment described above. For example, in a modification to the step illustrated in FIG. 2(C), only the front needle $16_5$ performs tucking when the yarn carrier 20*b* rightwardly moves in the step illustrated in FIG. 2(B), then the rear needle $18_3$ performs knitting when the yarn carrier 20*b* moves further leftward than the front needle $16_5$, then the front needle $16_1$ performs tucking and thereafter knitting for the second time and so forth as in the step illustrated in FIG. 2(D). In the step of FIG. 2(D), alternatively the rear needle $18_3$ may perform the second knitting when the yarn carrier 20*b* moves leftwardly from its position shown in FIG. 2(C), whereafter the third knitting may be performed as in the step illustrated in FIG. 3(A).

Also, the steps illustrated in FIGS. 3(C) and 3(D) may be replaced by a step of transferring the knit loops carried on the rear needle $18_3$ to the front needle $16_3$ by means of a loop transferring operation. In this instance, where the flat-knitting machine includes movable or holding down sinkers, the knit loops carried on the rear needle $18_3$ may be transferred to the front needle $16_3$ while they are held down by a movable sinker.

Where the flat-knitting machine is of an ordinary type, however, since the holding down force does not effectively act upon a loop formed by a rear needle, it is not easy to transfer the loop directly to a front needle. Therefore, preferably the knit loop of the front needle $16_3$ is transferred once to the rear needle $18_3$ so that the holding down force may act upon the two knit loops of the rear needle $18_3$ and then the two knit loops of the rear needle $18_3$ are transferred to the front needle $16_3$ as in the embodiment described above.

When the step described above is performed on the flat-knitting machine, a fastening portion of the transit yarn is formed at a start end portion of the knitting section in the traveling direction of the yarn carrier and is fastened to a stitch of the course An of FIG. 5. The yarn 22*b* is knitted, while it is caught by the front needles $16_1$ and $16_5$, successively three times to form loops by the same rear needle $18_3$ between the two front needles as shown in FIGS. 2(C), 2(D) and 3(A).

Thereafter, prior to knitting of the section Wb by the yarn 22*b*, the front and rear needle beds are first relatively displaced back to the arrangement for knitting an all needle structure rib stitch as shown in FIG. 4(A), and then the two rear needles $18_3$ and $18_4$ on the opposite sides of the front needle $16_3$ on which the yarn fastening portion is carried are advanced in accordance with the specific tucking operation pattern illustrated in FIG. 4(B), whereafter a knitting step beginning with a front needle $16_2$ directly preceding the front needle $16_3$ is started while the two rear needles $18_3$ and $18_4$ remain advanced.

The rear needles $18_3$ and $18_4$ are advanced in accordance with the special tucking operation pattern shown in FIG. 9 to prevent floating of the yarn fastening portion upon starting of knitting from the front needle $16_2$. Further, the rear needles $18_3$ and $18_4$ are moved at operation timings with respect to the position of the yarn carrier 20*b* faster than that in the ordinary operation pattern so that they may not catch the yarn 22*b* upon starting of knitting from the front needle $16_2$. The ordinary operation pattern is indicated by an alternate long and short dash line in FIG. 10, and the operation pattern which provides a faster operation than the ordinary operation pattern is indicated by a solid line in FIG. 10. More particularly, when the yarn carrier 20*b* reaches a position a shown in FIG. 10, the rear needles $18_3$ and $18_4$ are lowered along the solid line from the advanced position HT.

When knitting is started from the front needle $16_2$, the rear needle $18_1$ by which the yarn 22*b* is caught acts to hold down the yarn 22*b* so that the yarn 22*b* may be caught with certainty by the front needle $16_2$. Therefore, after the course B1 is knitted, the knit loop of the rear needle $18_1$ is removed from the rear needle 18 .

Knitting of the section Wb is performed by the yarn 22*b* and the front needles corresponding to the section Wb while the yarn carrier 20*b* is moved leftwardly and rightwardly in a reciprocating fashion within a range a little greater than the section Wb after the arrangement of the front and rear needle beds is returned to that for ordinary knitting. The sections Wa and Wc in the courses B1 to Bm are knitted in synchronism with knitting of the section Wb in the courses B1 to Bm.

Figure 12:
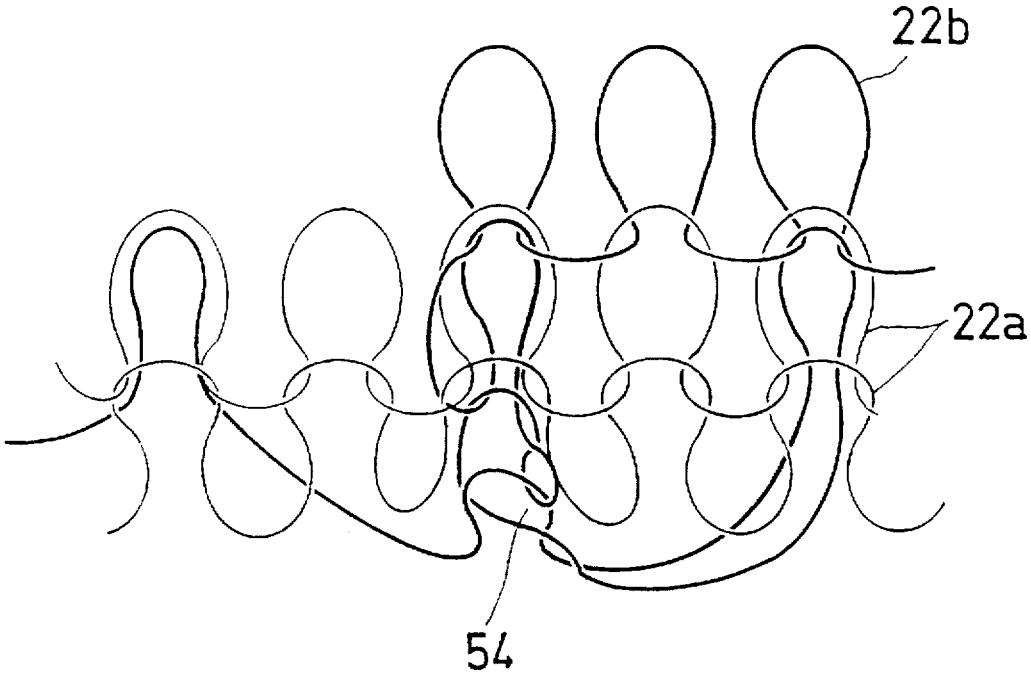
FIG. 12 is a schematic view showing a transit yarn fastening portion formed by the embodiment illustrated in FIGS. 2 to 4.
Figure 13:
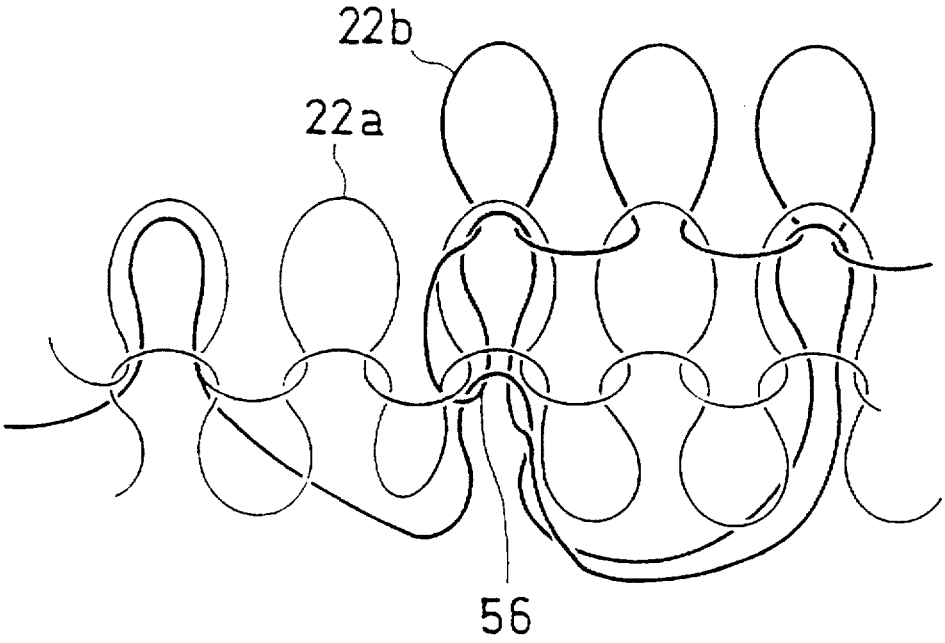
FIG. 13 is a schematic view showing another transit yarn fastening portion.

An example of the transit yarn fastening portion formed in such a manner as described above is shown in FIG. 12. In the example shown in FIG. 12, a transit yarn fastening portion 54 is formed from a knot of the three loops fastened to the loop of the yarn 22a by tying the yarn 22b. However, the transit yarn fastening portion may be formed otherwise from two or more loops. An example of a transit yarn fastening portion 56 formed from two loops is shown in FIG. 13.

While the embodiment of the present invention illustrated in FIGS. 2 to 4 relates to a method of forming a transit yarn fastening portion upon starting of knitting with a transit yarn, that is, the yarn 22b, also where knitting with the yarn 22b is ended and the yarn 22b forms a transit yarn portion again, it is preferable to form a transit yarn fastening portion on the yarn 22b. Also the transit yarn fasting portion upon ending of knitting with a transit yarn can be formed similarly to the yarn fastening portion upon starting of knitting with the transit yarn.

Method of Forming a Yarn Fastening Portion at a Knitting End Point of a Transit Yarn Another embodiment of the present invention will be described with reference to FIGS. 14, 15 and 16. In another embodiment, a yarn fastening portion upon ending of knitting with the yarn 22b is formed on the yarn 22b. In the embodiment illustrated in FIGS. 14 to 16, a fastening portion is formed on the yarn 22b in the proximity of the boundary between the sections Wb and Wc when the yarn carrier 20b is moved from the left to the right to knit the course Bm with the yarn 22b.

In FIGS. 14 to 16, each portion of a graphic form shown in FIG. 5(A) represents a step in which knitting of a yarn is performed while each portion of another graphic form shown in FIG. 5(B) represents another step in which tucking of a yarn is performed. Further, needles shown on the lower stage are needles on the front side needle bed, that is, needles which contribute to knitting, and needles shown on the upper stage are needles on the rear side needle bed, that is, needles which do not contribute to knitting. Further, a line 50 at the center indicates the boundary between the sections Wb and Wc shown in FIG. 6, and another line at the left end indicates the left end of the knitted fabric.

Figures 14A, 14B, 14C, 14D:
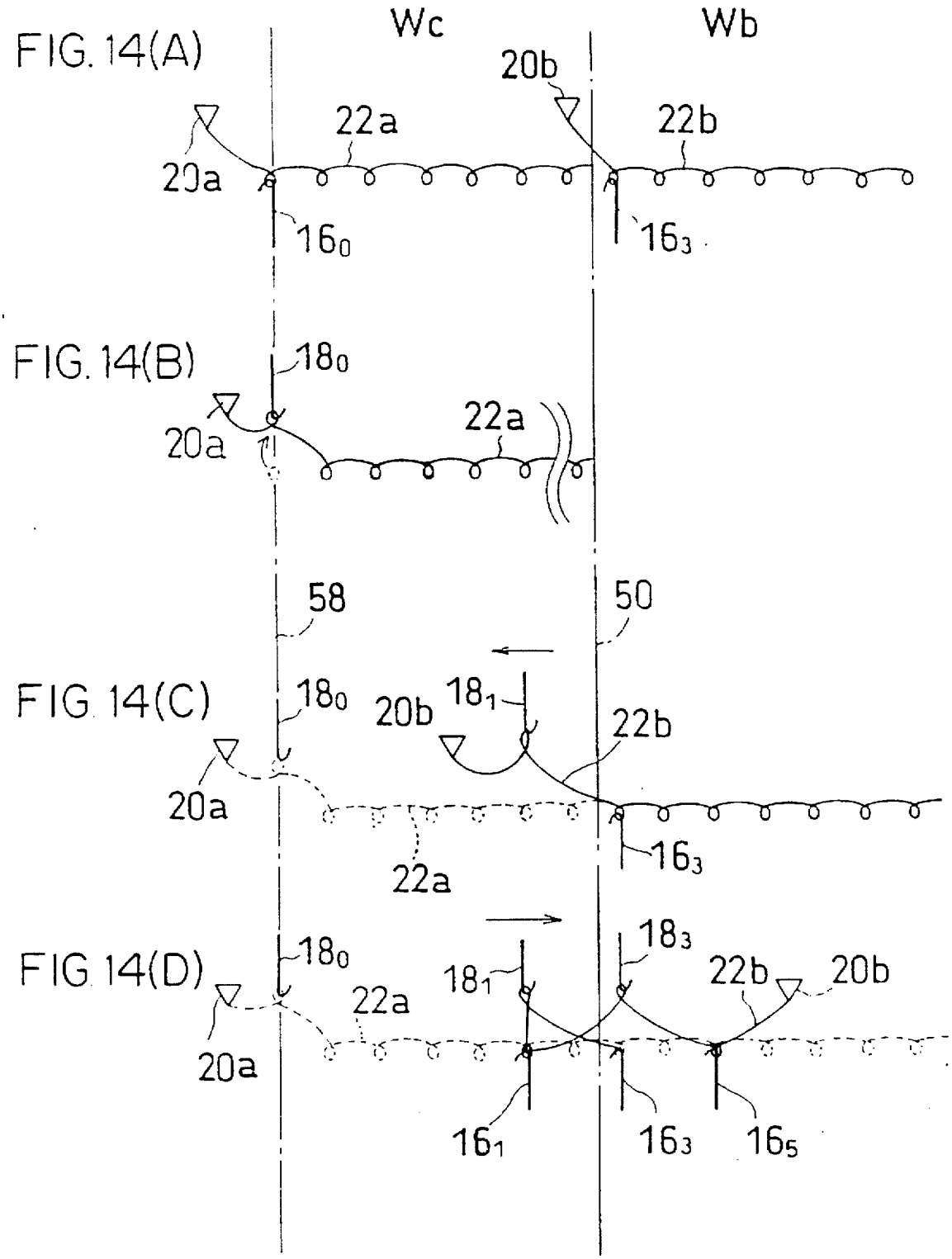
FIGS. 14(A) to 14(D), 15(A) to 15(D) and 16(A) to 16(E) are schematic views showing different steps of an embodiment of a method of forming a transit yarn fastening portion at a knitting end point of a transit yarn according to the present invention.

As shown in FIG. 14(A), at a point of time when knitting of the course Bm1 is ended, the yarn carriers 20a and 20a for the yarns 22a and 22b are at respective positions shown in FIG. 14(A). In this condition, a left end knit loop of the yarn 22a is first transferred to a rear needle $18_0$ corresponding to a front needle $16_0$ on which the knit loop is carried as shown in FIG. 14(B).

Then, the yarn carrier 20b is moved leftwardly as shown in FIG. 14(C), and thereupon, a second rear needle $18_1$ from the boundary 50 between the sections Wb and Wc toward the section Wc knits the yarn 22b. Consequently, a knit loop of the yarn 22b is formed and carried on the rear needle $18_1$.

Then, the front needle $16_1$ opposing to the rear needle $18_1$ tucks the yarn 22b and then the yarn carrier 20b is moved rightwardly as shown in FIG. 14(D). Meanwhile, the second rear needle $18_3$ from the rear needle $18_1$ knits the yarn 22b, and the second front needle $16_5$ from the second needle $16_3$ tucks the yarn 22b. Consequently, a knit loop of the yarn 22b is formed by and carried on the rear needle $18_3$, and a tuck loop of the yarn 22b is formed by and carried on the front needle $16_5$.

The step illustrated in FIG. 14(D) may be performed subsequently to the step illustrated in FIG. 14(B) without performing the step illustrated in FIG. 14(C) . In this instance, however, the knit loop of the yarn 22b carried on the front needle $16_3$ and the tuck loop of the yarn 22b carried on the front needle $16_5$ are pulled so that they become very small in size. Therefore, preferably the step illustrated in FIG. 14(D) is performed after the step illustrated in FIG. 14(C) is performed.

Figures 15A, 15B, 15C, 15D:
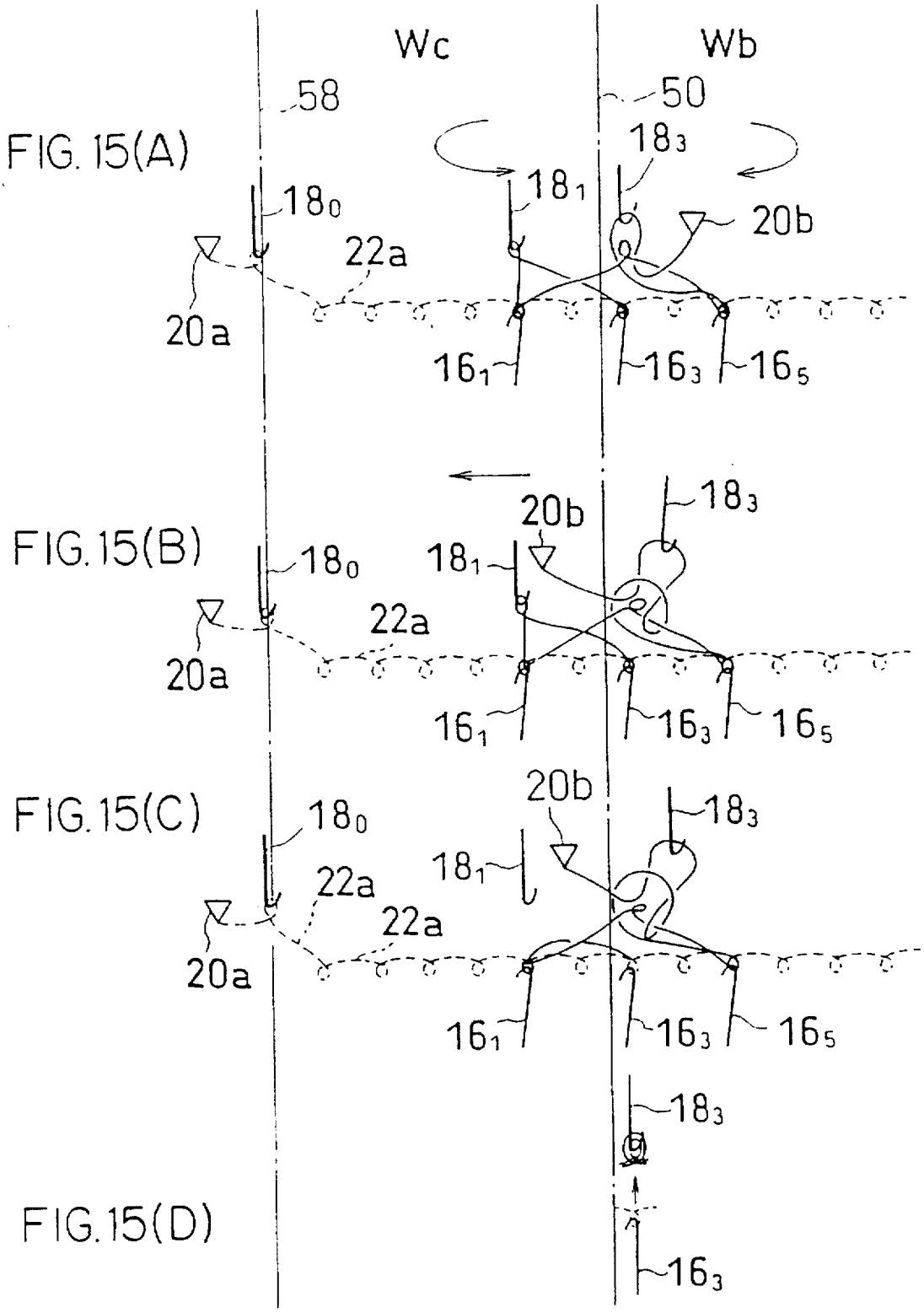

Then, the yarn carrier 20b is returned leftwardly farther than the rear needle $18_3$ at the left end of the section Wb and then moved rightwardly farther than the rear needle $18_3$ as shown in FIG. 15(A). When the yarn carrier 20b is moved rightwardly again, the rear needle $18_3$ knits the yarn 22b rather loosely. Consequently, a knit loop of the yarn 22b is further formed by and carried on the rear needle $18_3$.

Then, the yarn carrier 20b is returned leftwardly farther than the rear needle $18_3$ of the section Wb while the rear needle $18_3$ knits the yarn 22b loosely as shown in FIG. 15(B). As a result, a knit loop is formed by and carried on the rear needle $18_3$.

Thereafter, looping off of the rear needle $18_1$ is performed as shown in FIG. 15(C). Consequently, the knit loop of the yarn 22b carried on the front needle $16_3$ and t he tuck loop of the yarn 22b carried on the front needle $16_5$ are loosened.

Then, the knit loop carried on the front needle $16_3$ opposing to the rear needle $18_3$ is transferred to the rear needle $18_3$ by a loop transferring operation. Consequently, the two knit loops of the different yarns, that is, the knit loop of the yarn 22a and the knit loop of the yarn 22b are carried in an overlapping relationship on the rear needle $18_3$.

Figures 16A, 16B, 16C, 16D, 16E:
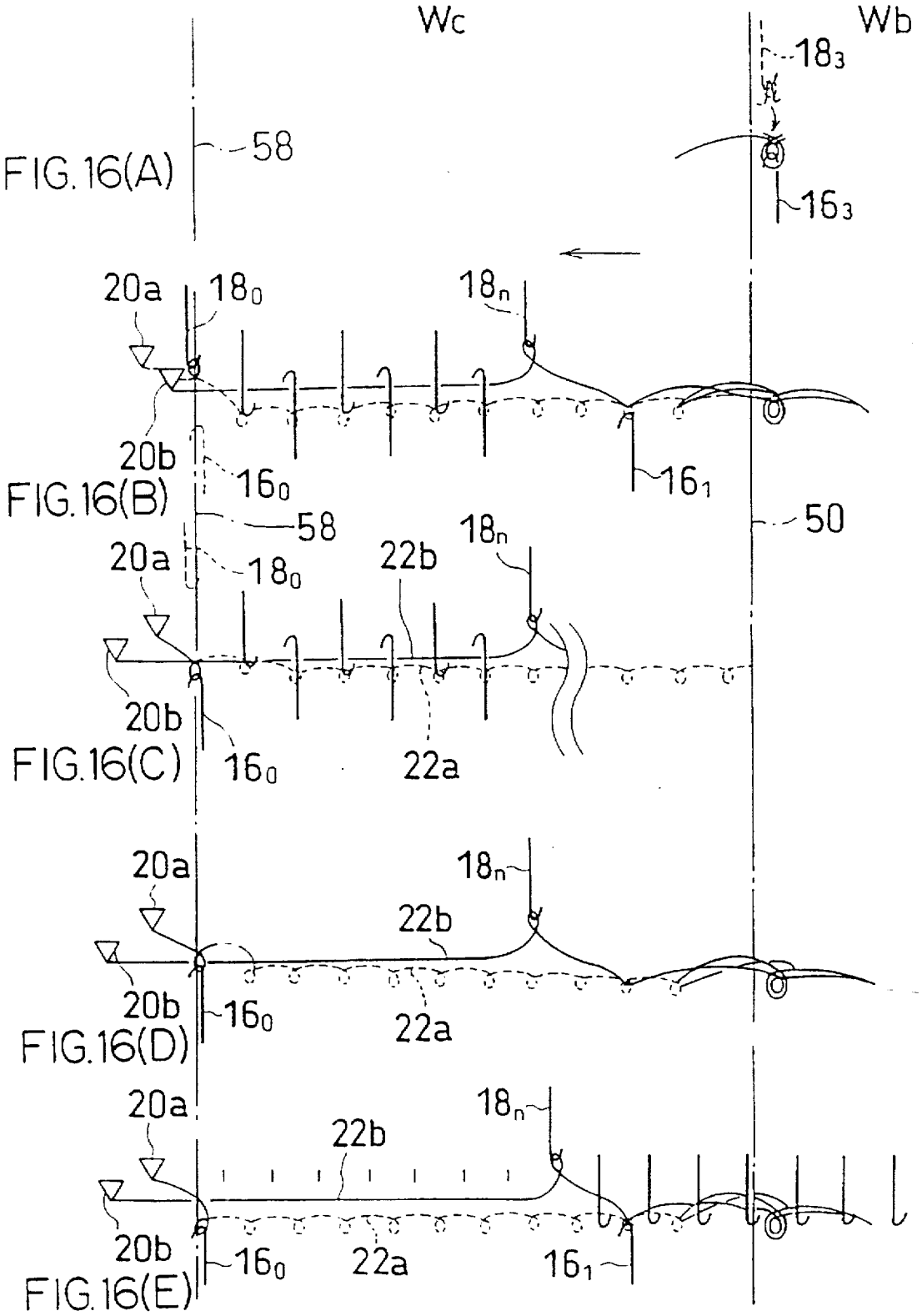

Then, the two knit loops carried on the rear needle $18_3$ are transferred to the front needle $16_3$ by a loop transferring operation as shown in FIG. 16(A). Consequently, the two knit loops of the different yarns, that is, the knit loop of the yarn 22a and the knit loop of the yarn 22b are carried in an overlapping relationship on the front needle $16_3$.

By the steps described above performed on the flat-knitting machine, a fastening portion of a transit yarn is formed at a terminal end portion of a knitting section in the traveling direction of a yarn carrier, and the yarn fastening portion is fastened to a loop of the course Bm1 in FIG. 6. The yarn 22b is successively knitted three times to form loops by the same rear needle $18_3$ between the front needles $16_1$ and $16_5$ while it is caught by the two front needles $16_1$ and $16_5$ as shown in FIGS. 14(D), 15(A) and 15(B).

Thereafter, the yarn carrier 20 b is moved to the left end start point position as shown in FIG. 16(B). In this instance, similarly as in the step of FIG. 2(B), the front and rear needles are successively advanced to hold down the transit yarn portion 22b.

It is to be noted that, in knitting the knit fabric 24 shown in FIG. 6, afLer knitting with the yarn 22b is ended, the yarn 22b is knitted by the front needle $16_1$ and a suitable rear needle $18_n$ leftward of the front needle $16_1$. The reason why the yarn 22b is knitted by the rear needle $18_n$ is that it is intended to confine the transit yarn so that the transit yarn may not move up in a floating manner when next knitting is entered.

Then, the knit loop of the rear needle $18_0$ is transferred to the front needle $16_0$ so that the transit yarn 22b is confined by the yarn 22a at the left end as shown in FIG. 16(C).

Then, the needles advanced in the step illustrated in FIG. 16(B) are retracted to the respective original positions as shown in FIG. 16(D). Then, a plurality of rear needles in the proximity of the knot are advanced in accordance with the special tucking operation pattern as shown in FIG. 16(E) to prevent the thus formed yarn fastening portion from moving in a floating manner in a next knitting operation. This is performed for the same reason to that in the step illustrated in FIG. 4(B).

Thereafter, knitting of th e courses C1 to Cn with the yarn 22a is performed. Upon knitting of the course C1, the needles advanced in the step illustrated in FIG. 16(E) are moved at operation timings with respect to the position of the yarn carrier 20a faster than those in the ordinary operation pattern so that they may not catch the yarn 22a in the next knitting operation. After the course C1 is knitted, the knit loop of the rear needle $18_n$ is removed from the rear needle $18_n$.

In FIG. 6, in the courses C1 to Cn, all of the sections Wa, Wb and Wc are knitted with the yarn 22a by moving the yarn carrier 20a back and forth in the leftward and rightward directions.

The transit yarn fastening portion formed by the steps of FIGS. 14 to 16 is formed from, similarly to the transit yarn fastening portion formed by the steps of FIGS. 2 to 4, a knot of three loops fastened to a loop of the yarn 22a by tying the yarn 22b. However, the transit yarn fastening portion to be formed at a knitting end portion with a transit yarn may be formed from two or more loops such as, for example, two, four or five loops.

Control Unit

Figure 17:
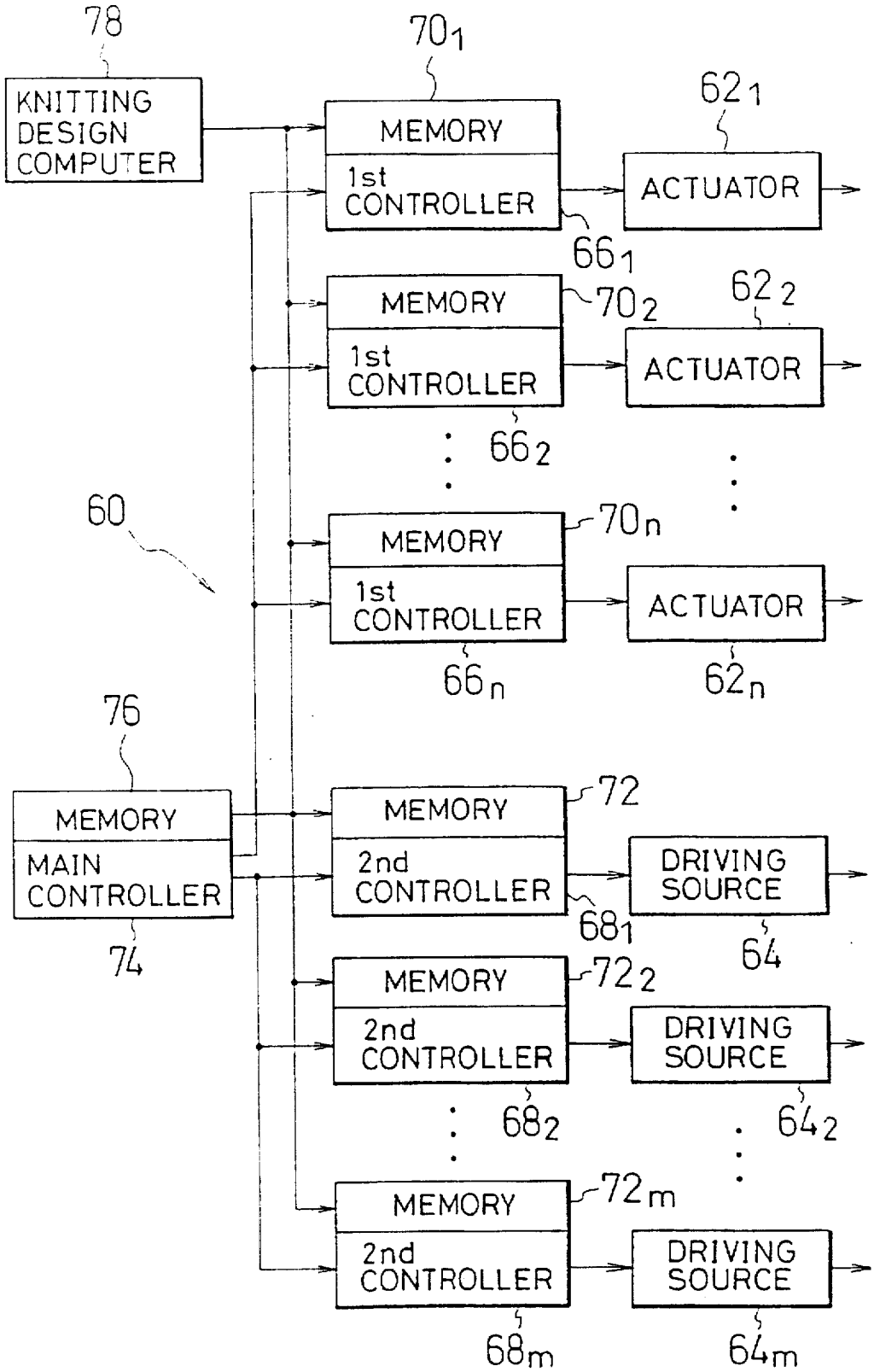
FIG. 17 is a block diagram of an electric circuit of a control apparatus for the flat-knitting machine shown in FIG. 1.

FIG. 17 shows an embodiment of a control unit 60 for use with a carriageless flat-knitting machine which performs the knitting methods described above. Referring to FIG. 17, the control unit is generally denoted at 60.

The carriageless flat knitting machine includes a plurality of actuators $62_1$ to $62_n$ provided corresponding to the knitting needles for reciprocating the corresponding needles, and a plurality of driving sources $64_1$ to $64_m$ provided corresponding to the yarn carriers for reciprocating the corresponding yarn carriers. For each of the actuators, a dc linear motor is used. For each of the driving sources, a servomotor with a speed reducer is used.

The control unit 60 includes a plurality of first controllers $66_1$ to $66_n$ provided corresponding to the actuators $62_1$ to $62_n$ for controlling the positions and movements of the corresponding actuators, and a plurality of second controllers $68_1$ to $68_m$ provided corresponding to the driving sources $64_1$ to $64_m$ for driving rotation of the corresponding driving sources. The numbers of the first and the second controllers $66_1$ to $66_n$ and $68_1$ to $68_m$ provided are equal to the numbers of the corresponding actuators and the the yarn carriers, respectively.

The first controllers $66_1$ to $66_n$ have memories $70_1$ to $70_n$ for storing operations of the first controllers based on a predetermined knitting plan, respectively. Similarly, the second controllers $68_1$ to $68_m$ have memories $72_1$ to $72_m$ for storing operations of the second controllers based on the predetermined knitting plan.

The first and second controllers $66_1$ to $66_n$ and $68_1$ to $68_m$ are connected to a common main controller 74 for providing operation timing signals to the first controllers, which perform position control of the needles, in synchronism with operations of the second controllers, which perform position control of the yarn carriers. The main controller 74 is connected to a memory 76 in which operations of the main controller 74 based on the predetermined knitting plan are stored.

Data to be stored into the memories $70_1$ to $70_n$, $72_1$ to $72_m$ and 76 are data based on the predetermined knitting plan and are produced by a knitting design computer 78 based on the predetermined knitting plan. The data produced by the knitting design computer 78 are either supplied directly to the individual memories by such means as a data communication line or supplied to the individual memories indirectly by some other communication means such as a tape memory, a disk memory or a bubble memory.

Data to be stored in the memories of the first controllers $66_1$ to $66_n$ are position data of the corresponding actuators and hence the corresponding needles, knit pattern data and so forth for each knitting course. Data to be stored into the memories of the second controllers $68_1$ to $68_n$ are data for each knitting course such as stretches of reciprocating movements of the corresponding yarn supply units and hence the corresponding yarn carriers and a traveling speed pattern. Data to be stored in the memory 76 of the main controller 74 are data for selection of those yarn supply units to be moved, for selection of needles to be operated depending upon the positions of the yarn supply units and so forth for each knitting course.

The first and second controllers $66_1$ to $66_n$ and $68_1$ to $68_m$ operate the corresponding actuators or driving sources based on the data in the corresponding memories under the control of the main controller 74. Consequently, the flat-knitting machine knits a multi-color single knit fabric having a predetermined knitting pattern successively changing the traveling order of the plurality of yarn carriers.

The invention having now fully described, it will be apparent to one of ordinary skill in the art that many changes and modifications can be made thereto without departing from the spirit and scope of the invention as set forth herein.

What is claimed is:

1. A method of forming a transit yarn fastening portion while forming, by a flat-knitting machine including a yarn carrier and first and second needle beds, a knit fabric having a transit yarn section in which a yarn from said yarn carrier is not knitted but forms a transit yarn fastening portion and the knit fabric further having a knitting section in which the yarn from said yarn carrier is knitted, comprising the steps of:

successively forming two or more loops of the transit yarn by each of at least one needle on the first needle bed, wherein the first needle bed does not contribute to knitting, and wherein each of at least one of the needles is located in the proximity of a boundary between the transit yarn section and the knitting section; and transferring the loops formed by each of at least one of the needles of the first needle bed to one of the needles on the second needle beds wherein the second needle bed contributes to knitting.

2. A method as claimed in claim 1, wherein the two or more loops are successively formed by the one of the needles on the first needle bed.

3. A method as claimed in claim 1, wherein the step of successively forming two or more loops includes the steps of catching the transit yarn by one of a pair of needles on the second needle bed , wherein the pair of needles are spaced away from each other, and said one of the needles on the first needle bed is positioned between the pair of needles, forming a first loop by said one of the needles, catching the transit yarn by the other one of the pair of needles and forming a second loop by said one of the needles.

* * * * *

UNITED STATES PATENT AND TRADEMARK OFFICE

CERTIFICATE OF CORRECTION

PATENT NO. : 5,758,518

DATED : June 2, 1998

INVENTOR(S) : Nobuhisa Shu and Tetsuo Segura

It is certified that error appears in the above-identified patent and that said Letters Patent is hereby corrected as shown below:

Column 1 Line 14 "arid" should read --and--.

Column 1 Line 43 "all single" should read --a single--.

Column 1 Line 45 "of-the" should read --of the--

Column 2 Line 53 "according Lo" should read --according to--.

Column 2 Line 58 "illustraLing" should read --illustrating--.

Column 4 Line 39 "shown in IIG. 6" should read --shown in FIG. 6--.

Column 4 Line 52 "left, end" should read --left end--.

Column 5 Line 30 "section We" should read --section Wc--.

Column 7 Line 53 "$16_2$" should read --$16_5$--.

Column 8 Line 58 "18." should read --$18_1$--.

Column 9 Line 44 "20a and 20a" should read --20a and 20b--.

Column 10 Line 20 "t he tuck loop" should read --the tuck loop--.

Column 10 Line 49 "afLer" should read --after--.

Column 11 Line 1 "th e courses" should read --the courses--.

UNITED STATES PATENT AND TRADEMARK OFFICE

CERTIFICATE OF CORRECTION

PATENT NO. : 5,758,518

DATED : June 2, 1998

INVENTOR(S) : Nobuhisa Shu and Tetsuo Segura

It is certified that error appears in the above-identified patent and that said Letters Patent is hereby corrected as shown below:

Claim 1 Column 12 Line 48 "second needle beds" should read --second needle bed,--.

Signed and Sealed this

Twenty-ninth Day of September, 1998

*Attest:*

Bruce Lehman

BRUCE LEHMAN

*Attesting Officer*

*Commissioner of Patents and Trademarks*